US005350011A

United States Patent [19]

Sylvester

[11] Patent Number: 5,350,011

[45] Date of Patent: Sep. 27, 1994

[54] DEVICE AND METHOD FOR THERMALLY INSULATING A STRUCTURE TO PREVENT THERMAL SHOCK THEREIN

[75] Inventor: Robert L. Sylvester, Pensacola, Fla.

[73] Assignee: Westinghouse Electric Corporation, Pittsburgh, Pa.

[21] Appl. No.: 100,841

[22] Filed: Aug. 2, 1993

[51] Int. Cl.[5] ..... F28F 13/00

[52] U.S. Cl. ..... 165/135; 122/511; 122/34

[58] Field of Search ..... 165/135; 122/382, 405, 122/32, 34, 511, 512

[56] References Cited

U.S. PATENT DOCUMENTS

| | | | |
|---|---|---|---|
| 2,604,081 | 7/1952 | Henc | 122/512 |
| 3,029,796 | 4/1962 | Simmons et al. | 165/135 |
| 3,743,780 | 7/1973 | Camp . | |
| 4,057,033 | 11/1977 | Schlichting et al. . | |
| 4,079,701 | 3/1978 | Hickman et al. . | |
| 4,368,694 | 1/1983 | Ward et al. | 122/34 |
| 4,552,210 | 11/1985 | Malaval . | |
| 5,083,529 | 1/1992 | Sundheimer | 122/32 |

*Primary Examiner*—Henry C. Yuen
*Attorney, Agent, or Firm*—Walter S. Stevens

[57] ABSTRACT

Device and method for thermally insulating a structure to prevent thermal shock therein, which structure may be a feedwater inlet nozzle of the kind typically found on nuclear steam generators. The device comprises a sleeve extending into the bore of the nozzle for thermally insulating the nozzle and joined to the nozzle to affix the sleeve to the nozzle. The sleeve is so joined to the nozzle so as to define a joint therebetween. A liner is concentrically disposed in the sleeve so as to cover the joint to thermally insulate the joint and joined to the sleeve for affixing the liner to the sleeve. The nozzle may have a temperature significantly higher than the cooler feedwater flowing through the bore in the nozzle thereby giving rise to a potential for thermal shock in the nozzle, which thermal shock in turn may induce metal fatigue in the nozzle. The device, as it is disposed in the bore of the nozzle, thermally insulates the nozzle to prevent thermal shock and metal fatigue therein.

12 Claims, 5 Drawing Sheets

DEVICE AND METHOD FOR THERMALLY INSULATING A STRUCTURE TO PREVENT THERMAL SHOCK THEREIN

BACKGROUND OF THE INVENTION

This invention generally relates to thermal insulating devices and methods and more particularly relates to a device and method for thermally insulating a structure to prevent thermal shock therein, which structure may be a feedwater inlet nozzle of the kind typically found on nuclear steam generators.

Although thermal insulating devices and methods are known, it has been observed that such devices and methods have a number of operational problems associated with them which make these devices and methods unsuitable for thermally insulating nuclear steam generator feedwater inlet nozzles to prevent thermal shock therein. However, before these problems can be appreciated, some background is necessary as to the structure and operation of a typical nuclear steam generator and its associated feedwater inlet nozzle.

In this regard, a typical nuclear steam generator, such as is associated with pressurized water nuclear reactors, generates steam when heat is transferred from a heated and radioactive primary fluid to a non-radioactive secondary fluid (i.e., feedwater) of lower temperature. The secondary fluid flows into the steam generator through a feedwater inlet nozzle attached to the steam generator. The inlet nozzle is in fluid communication with a perforated feedring disposed in the steam generator. As the secondary fluid flows into the feedring, it also flows through the perforations of the feedring. The heated primary fluid flows through a plurality of tubes disposed in the steam generator as the secondary fluid simultaneously flows through the feedwater nozzle and the perforations of the feedring to surround the exterior surfaces of the tubes. The walls of the tubes conduct heat from the heated primary fluid flowing through the tubes to the secondary fluid of lower temperature surrounding the exterior surfaces of the tubes. As heat is transferred from the primary fluid to the secondary fluid, a portion of the secondary fluid vaporizes into steam which is piped to a turbine-generator for generating electricity in a manner well known in the art.

However, the temperature of the feedwater inlet nozzle may be substantially higher than the temperature of the relatively cold secondary fluid or feedwater flowing into the steam generator through the feedwater inlet nozzle. This temperature difference may be as great as approximately 100 degrees Fahrenheit during normal operation or 500 degrees Fahrenheit during transient conditions and may subject the nozzle to a phenomenon commonly referred to in the art as "thermal shock".

With respect to such transient conditions, relatively cold (e.g., 32 degrees Fahrenheit) secondary fluid from the auxiliary feedwater system is delivered to the feedwater nozzle during certain transient conditions. Such inflow of cold feedwater can cause thermal cycling and can induce the previously mentioned "thermal shock" in the nozzle. "Thermal shock" is defined herein as mechanical or thermal stress induced in a material due to rapid temperature changes in the material. Such "thermal shock" may induce metal fatigue in the nozzle. Such metal fatigue may in turn decrease the useful life of the nozzle and the steam generator to which it is attached. Therefore, a problem in the art is to mitigate the effects of "thermal shock" that may be experienced by the feedwater inlet nozzle in order to reduce metal fatigue therein so that the useful design life of the steam generator is not decreased. Maintaining the useful life of the steam generator avoids the cost of replacing the steam generator, which replacement cost may be approximately $30 million dollars. It is therefore desirable to mitigate the effects of "thermal shock" in the feedwater inlet nozzle in order to avoid the costs associated with replacing the steam generator.

More specifically, relatively cold (e.g., 32 degrees Fahrenheit) from the auxiliary feedwater system is delivered to the feedwater nozzle during certain transient conditions. Such inflow of cold feedwater is commonly referred to as thermal cycling and can induce the previously mentioned "thermal shock" in the nozzle.

Thermal insulating devices and methods are known. A device for reducing circumferential thermal gradients along the length of a feedwater inlet nozzle is disclosed in U.S. Pat. No. 4,057,033 issued Nov. 8, 1977 in the name of John Schlichting titled "Industrial Technique.'-'According to this patent, an inlet feedwater nozzle is provided with a nozzle shroud to eliminate circumferential thermal gradient buildup in the nozzle at low flow rates and is also provided with a thermal sleeve-flange juncture to protect the nozzle from the thermal stresses resulting from large feedwater temperature changes. However, the nozzle of the Schlichting patent is not connected to a feedring and therefore is apparently unusable in steam generators of current design.

Hence, although thermal insulating devices and methods are known in the prior art, the prior art does not appear to disclose a device and method for suitably insulating a structure to prevent thermal shock therein, which structure may be a nuclear steam generator feedwater inlet nozzle.

Therefore, what is needed is a device and method for thermally insulating a structure to prevent thermal shock therein, which structure may be a feedwater inlet nozzle of the kind typically found on nuclear steam generators.

SUMMARY OF THE INVENTION

Disclosed herein are a device and method for thermally insulating a structure to prevent thermal shock therein, which structure may be a feedwater inlet nozzle of the kind typically found on nuclear steam generators. The device comprises a sleeve extending into the bore of the nozzle for thermally insulating the nozzle and joined to the nozzle so as to affix the sleeve to the nozzle. As the sleeve is joined to the nozzle, a joint is defined therebetween. A liner is concentrically disposed in the sleeve so as to cover the joint to thermally insulate the joint and joined to the sleeve for affixing the liner to the sleeve, so that the sleeve and liner are captured in the bore of the nozzle. The nozzle may have a temperature significantly higher than the cooler feedwater flowing through the bore in the nozzle thereby giving rise to a potential for "thermal shock". If the device of the present invention were not disposed in the nozzle, such thermal shock may induce metal fatigue in the nozzle. However, the device of the present invention, as it is disposed in the bore of the nozzle, thermally insulates the nozzle and the joint to prevent thermal shock and metal fatigue in the nozzle and the joint.

An object of the present invention is to provide a device and method for thermally insulating a structure to prevent thermal shock therein, which structure may be a nuclear steam generator feedwater inlet nozzle having a bore for transmitting a fluid therethrough.

A feature of the present invention is the provision of a sleeve adapted to be joined to the nozzle to define a joint therebetween, the sleeve extending into the bore for thermally insulating the nozzle as the fluid is transmitted through the nozzle, so that the nozzle does not experience thermal shock and metal fatigue.

Another feature of the present invention is the provision of a liner disposed in the sleeve and covering the joint for thermally insulating the joint as the fluid is transmitted through the nozzle, so that the joint does not experience thermal shock and metal fatigue.

An advantage of the present invention is that "thermal shock" to the nozzle and metal fatigue therein are reduced because the nozzle is thermally insulated as the secondary fluid (i.e., feedwater) is transmitted through the nozzle.

These and other objects, features, and advantages of the present invention will become apparent to those skilled in the art upon a reading of the following detailed description when taken in conjunction with the drawings wherein there is shown and described illustrative embodiments of the invention.

BRIEF DESCRIPTION OF DRAWINGS

While the specification concludes with claims particularly point out and distinctly claiming the subject matter of the invention, it is believed the invention will be better understood from the following description taken in conjunction with the accompanying drawings wherein:

DESCRIPTION OF THE PREFERRED EMBODIMENT

The temperature of a nuclear steam generator feedwater inlet nozzle may be substantially higher than the temperature of the secondary fluid or feedwater flowing into the steam generator through the feedwater inlet nozzle. This temperature difference may be as great as approximately 100 degrees Fahrenheit during normal operation or 500 degrees Fahrenheit during transient conditions and may subject the nozzle to a phenomenon commonly referred to in the art as "thermal shock". Such "thermal shock" may induce metal fatigue in the nozzle. The metal fatigue induced in the nozzle may in turn reduce the useful life of the nozzle and the steam generator to which it is attached. It is therefore desirable to lessen metal fatigue in the feedwater inlet nozzle so that the useful life of the steam generator is not reduced. Therefore, a problem in the art is to mitigate the effects of "thermal shock" that may be otherwise experienced by the feedwater inlet nozzle during normal and transient operation of the steam generator. According to the invention, this problem is solved by the provision of a device and method for thermally insulating a structure to prevent thermal shock therein, which structure may be a nuclear steam generator feedwater inlet nozzle of the kind typically found on nuclear steam generators.

However, before disclosing the subject matter of the present invention, it is instructive first to briefly describe the structure and operation of a typical nuclear steam generator and its associated feedwater inlet nozzle.

Figure 1:
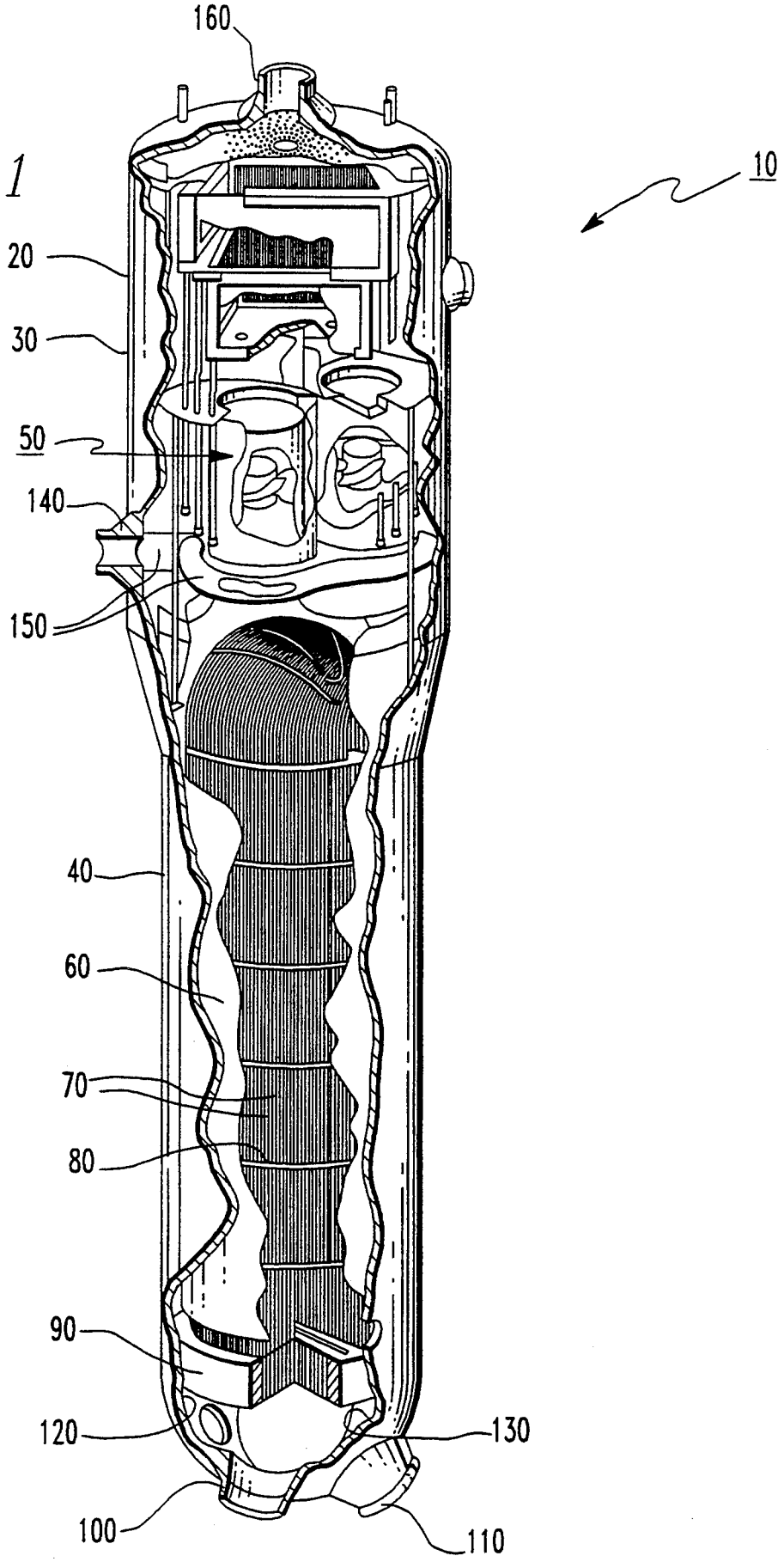
FIG. 1 shows in partial elevation a typical nuclear steam generator with parts removed for clarity, the steam generator having a feedwater inlet nozzle integrally attached thereto.

Therefore, referring to FIG. 1, there is shown a typical nuclear steam generator, generally referred to as 10, for generating steam. Steam generator 10 comprises an outer hull 20 having an upper portion 30 and a lower portion 40. Disposed in upper portion 30 is moisture separating means, generally referred to as 50, for separating a steam-water mixture (not shown) in the manner disclosed more fully hereinbelow. Disposed in lower portion 40 is an annular inner hull 60 which is closed at its top end except for a plurality of openings in its top end for allowing passage of the steam-water mixture from inner hull 60 to moisture separating means 50. Moreover, disposed in inner hull 60 are a plurality of steam generator tubes 70 that matingly extend through respective openings in a plurality of support plates 80, so that each tube 70 is laterally supported thereby. Disposed in lower portion 40 and attached thereto is a tube sheet 90 having holes for receiving the respective ends of each tube 70. Each tube 70 is attached to tube sheet 90, such as by weldments (not shown), so that each tube 70 is axially supported thereby.

Still referring to FIG. 1, disposed on outer hull 20 are a first inlet nozzle structure 100 and a first outlet nozzle structure 110 in fluid communication with an inlet plenum chamber 120 and with an outlet plenum chamber 130, respectively. Moreover, attached, such as by a weldment 135, to outer hull 20 at a position above tubes 70 is a feedwater inlet nozzle or second inlet nozzle structure 140, which is in fluid communication with a perforated feedring 150 disposed in upper portion 30 for allowing entry of non-radioactive secondary fluid (not shown) into upper portion 30. Second inlet nozzle structure 140 may be formed, for example, from low alloy steel and may obtain a maximum temperature of approximately 500 degrees Fahrenheit during operation of steam generator 10. Second inlet nozzle structure 140 has a step bore 143 therein for passing or transmitting the secondary fluid therethrough generally along a flow path defined by the arrows shown in the several figures (e.g., see FIGS. 1, 2 and 3). Bore 143 has an inner surface 144 defining a first diameter 145 and also defining a second diameter 147 in fluid communication with first diameter 145. Second diameter 147 is larger than first diameter 145, so as to form an inwardly jutting generally cervico-orbicular or annular lip portion 148 between diameters 145/147. Lip portion 148 may have a so-called "weld build-up" (not shown) thereon integrally attached to lip portion 148 (see FIGS. 2 and 3), for reasons disclosed presently. It will be appreciated that such a "weld build-up" which may be formed of Alloy 600 or 690 material, allows subsequent welding of second end portion 200 without post-weld heat treat. Moreover, lip portion 148 may face generally towards the interior of steam generator 10, as described more fully hereinbelow. As shown in FIG. 1, a second outlet nozzle structure 160 is disposed on the top of upper portion 30 for exit of steam from steam generator 10.

During operation of steam generator 10, radioactive and heated primary fluid, such as borated demineralized water, enters inlet plenum chamber 120 through first inlet nozzle structure 100 and flows through tubes 70 to outlet plenum chamber 130 where the primary fluid exits steam generator 10 through first outlet nozzle structure 110. As the primary fluid flows through tubes 70, the secondary fluid, which may be demineralized water having a bulk mean temperature of approximately 440 degrees Fahrenheit during normal operation and 32 degrees Fahrenheit during transient conditions, simultaneously enters feedring 150 through second inlet nozzle structure 140 and flows downwardly from the perforations of feedring 150 to eventually surround tubes 70. A portion of this secondary fluid vaporizes into a steam-water mixture due to conductive heat transfer from the primary fluid to the secondary fluid through the walls of tubes 70. This steam-water mixture flows upwardly from tubes 70 and is separated by moisture separating means 50 into saturated water and dry saturated steam, which dry saturated steam exits steam generator 10 through second outlet nozzle 160. The structure and operation of such a typical nuclear steam generator is more fully described in commonly owned U.S. Pat. No. 4,079,701 titled "Steam Generator Sludge Removal System" issued Mar. 21, 1978 in the name of Robert A. Hickman, et al., the disclosure of which is hereby incorporated by reference.

However, the temperature of second inlet nozzle structure 140 may be substantially higher than the bulk mean temperature of the secondary fluid or feedwater flowing into steam generator 10 through second inlet nozzle structure 140. This temperature difference may subject second inlet nozzle structure 140 to the previously mentioned phenomenon of "thermal shock" which may induce metal fatigue in second inlet nozzle structure 140. Such metal fatigue may in turn reduce the useful life of steam generator 10. It is therefore prudent to lessen the potential for metal fatigue in second inlet nozzle structure 140 so that the useful life of the steam generator 10 is not reduced. Consequently, in order to mitigate "thermal shock" and reduce metal fatigue, the present invention provides a device and method for thermally insulating second inlet nozzle structure 140 (i.e., the feedwater inlet nozzle).

Therefore, referring to FIGS. 2, 3, 4 and 5, there is shown the apparatus of the present invention, which is a device, generally referred to as 170, for thermally insulating a structure to prevent thermal shock therein, which structure may be second inlet nozzle structure 140 having bore 143 for transmitting the relatively cold secondary fluid (i.e., feedwater) therethrough. Device 170 comprises a sleeve 180 having a first end portion 190, a second end portion 200 and an inside surface 205. Integrally attached to and outwardly projecting from inside surface 205 is an annular flange 207 for reasons provided hereinbelow. Sleeve 180 may be formed of "INCONEL 690", or the like, for resisting metal fatigue and stress corrosion cracking. In this regard, "INCONEL 690" comprises by weight percent approximately 60.0% nickel, 30.0% chromium, 9.5% iron and 0.03% carbon and is available from the International Nickel Company located in Upland, Calif. The first end portion 190 of sleeve 180 is suitably joined to feedring 150, such as by a circular weldment 210. Second end portion 200 of sleeve 180 is joined to lip portion 148 of nozzle structure 140, such as by a circular weldment 220, so as to define a welded joint 230 therebetween. As described more fully hereinbelow, joint 230 is thermally insulated to preclude contact with the relatively cold secondary fluid in order to prevent thermal shock in joint 230. It will be understood from the description hereinabove, that sleeve 180 extends into bore 143 a predetermined distance to thermally insulate a thermally limiting portion of second inlet structure 140, which thermally limiting portion may be a nozzle knuckle inner radius 230. In this regard, the nozzle knuckle inner radius 230 is thermally limiting due to its relatively thicker transverse cross section. Such a nozzle knuckle inner radius 230 is subjected to relatively large thermal gradients when relatively cold feedwater is delivered to steam generator 10 through nozzle structure 140. Such relatively high thermal gradients result in thermal stresses, which when cycled contribute to high fatigue stresses.

Still referring to FIGS. 2, 3, 4 and 5, a generally tubular liner 204 is concentrically disposed in sleeve 180 so as to cover joint 230 for thermally insulating joint 230 as the relatively cold secondary fluid is transmitted through bore 143. It is important to thermally insulate joint 230 in order to prevent thermal shock in joint 230. This is important because preventing thermal shock in joint 230 reduces the likelihood that joint 230 will fail due to metal fatigue and thus ensures that sleeve 180 will remain affixed to second inlet nozzle structure 140 to perform its insulating function as steam generator 10 operates. Liner 240 may also be formed of "INCONEL 690" for preventing metal fatigue and stress corrosion cracking therein. Liner 240 has a first end portion 250 joined, such as by circular weldment 260, to flange 207 for affixing liner 240 to sleeve 180. Liner 240 also has a generally funnel-shaped second end portion 270 intimately slidably engaging inner surface 144 of bore 143, so that there is a relatively close tolerance fit between second end portion 270 and inner surface 144. Second end portion 270 slidably engages inner surface 144 for providing margin for movement of second end portion 270, which movement may be caused by thermal expansion of liner 240. In addition, second end portion 270 of liner 240 slidably engages inner surface 144 to allow welding of liner 240 to flange 207 without the need for post-weld heat treat to relieve mechanical stresses. Welding second end portion 270 to inner surface 144 is not preferred because such welding would necessarily require subsequent heat treating of the weldment to relieve mechanical stresses and would not provide sufficient margin for thermal expansion. On the other hand, second end portion 270 may be welded to inner surface 144, if desired, to provide increased assurance that liner 240 will not become a loose part in steam generator 10 in the event that weldment 260 fails and liner 240 becomes separated from sleeve 180. However, this is not preferred. It will be appreciated from the description hereinabove that the secondary fluid will not contact joint 230 because liner 240 sealingly covers joint 230 as first end portion 250 of liner 240 is welded to sleeve 180 and as second end portion 270 of liner 240 intimately slidably engages inner surface 144. Preventing substantial contact of the secondary fluid with joint 230 prevents thermal shock to joint 230 which in turn prevents metal fatigue in joint 230.

OPERATION

Sleeve 180 is extended into bore 143 of second inlet nozzle structure 140 by any convenient means and joined to lip portion 148, such as by circular weldment 220, for thermally insulating second inlet nozzle structure 140. As previously mentioned, joining sleeve 180 to lip portion 148 in this manner defines joint 230 therebetween. The attachment of sleeve 180 to lip portion 148 may be made, for example, during fabrication of steam generator 10. First end portion 190 of sleeve 180 is attached to feedring 150, such as by circular weldment 210. In this manner, sleeve 180 is rigidly affixed within bore 143 of second inlet nozzle structure 140 as sleeve 180 is joined to lip portion 148 and attached to feedring 150.

Liner 240 is concentrically disposed in sleeve 180 so as to cover joint 230 for thermally insulating joint 230. Liner 240 may be disposed in sleeve 180 by inserting liner 240 into bore 143 from a position exterior to steam generator 10 until first end portion 250 of liner 240 abuts flange 207 of sleeve 180 and so that second end portion 270 intimately slidably engages inner surface 144 of bore 143. First end portion 250 of liner 240 is then joined to flange 207, such as by circular weldment 260, for affixing liner 240 to sleeve 180 so that both sleeve 180 and liner 240 are captured in bore 143.

Figure 2:
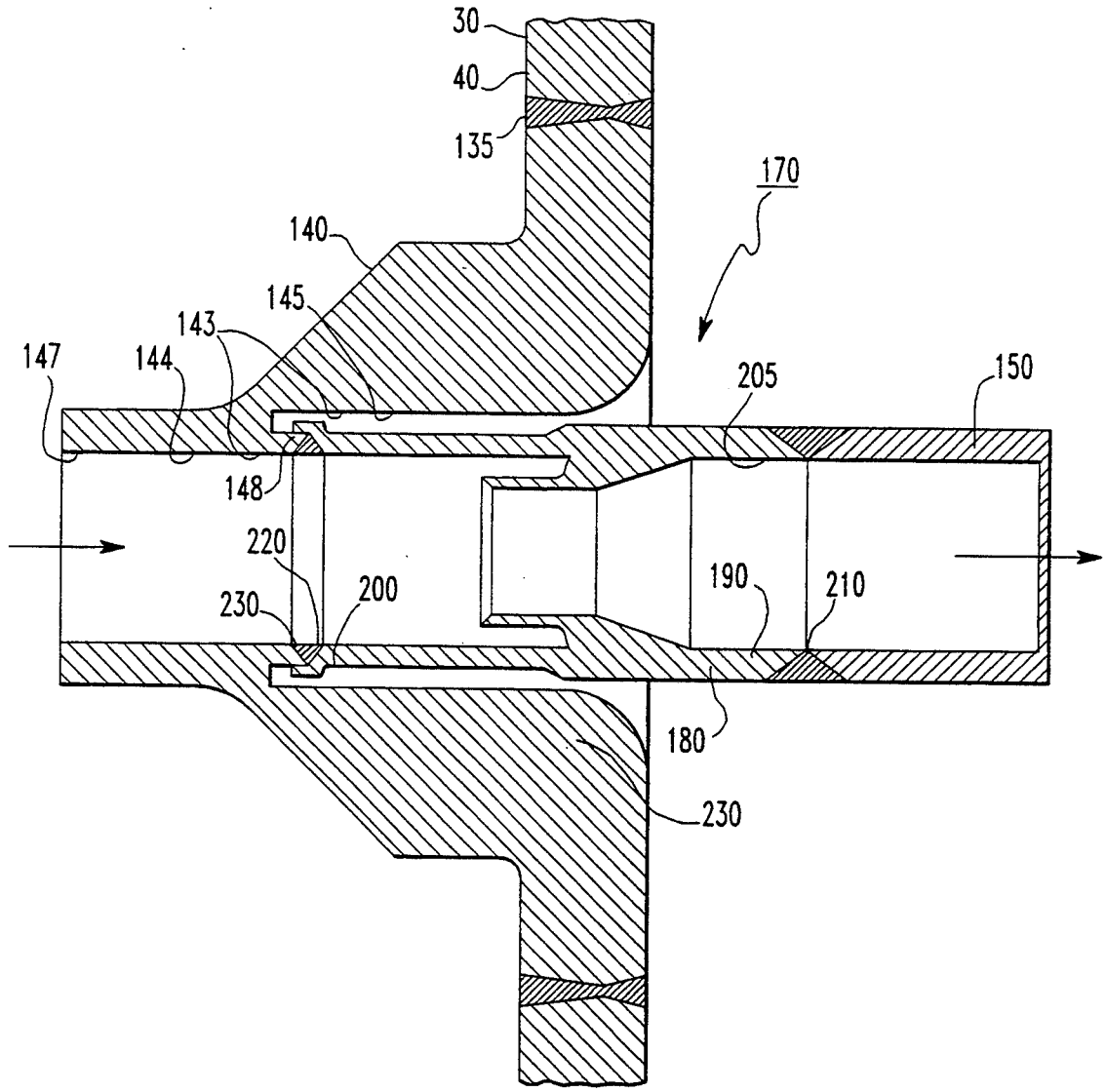
FIG. 2 shows in elevation a sleeve extending into the feedwater inlet nozzle to thermally insulate the nozzle and joined to the feedwater inlet nozzle so as to define a joint therebetween.
Figure 3:
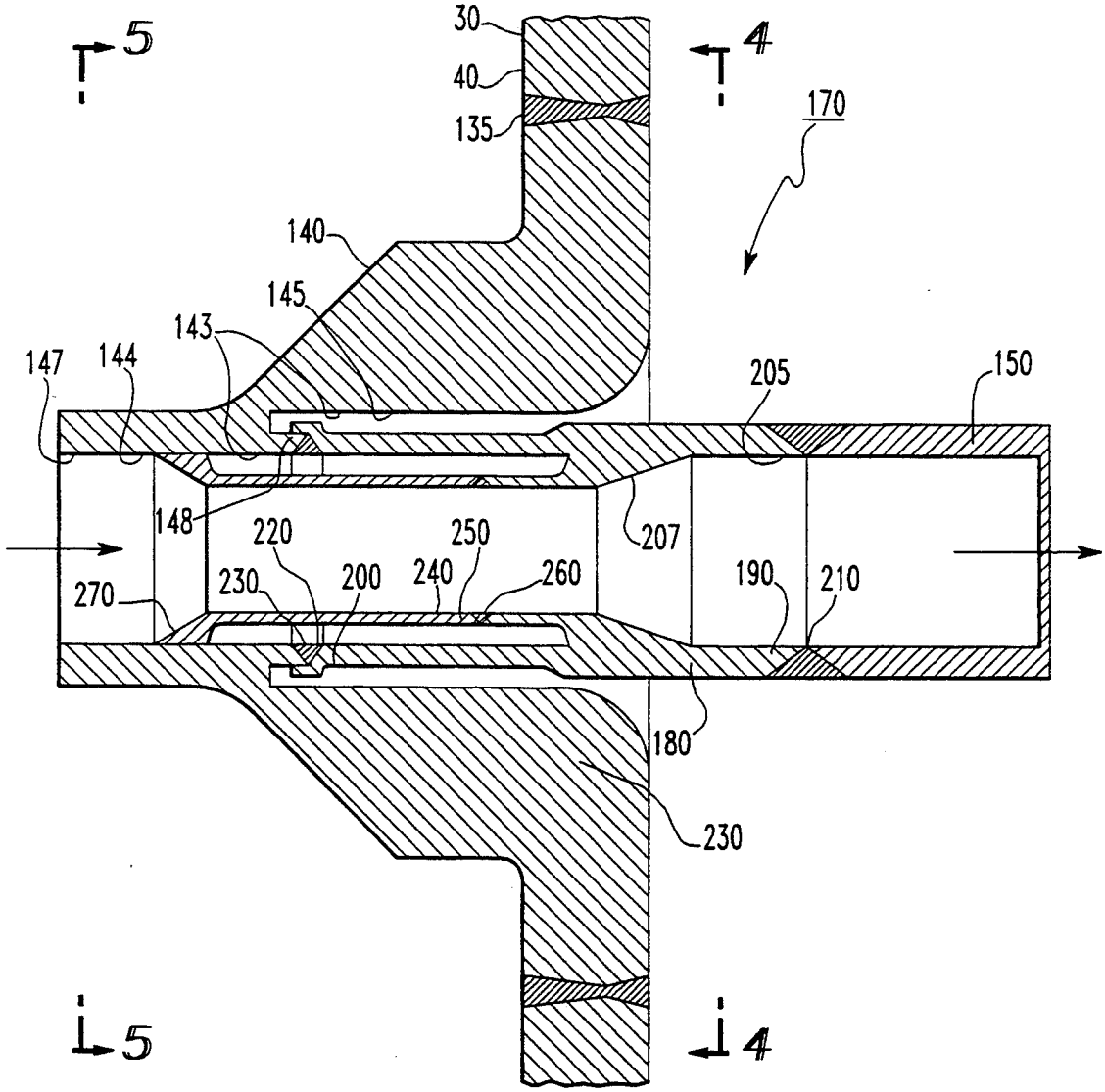
FIG. 3 shows in elevation a liner disposed in the sleeve and joined thereto, the liner covering the joint to thermally insulate the joint.
Figure 4:
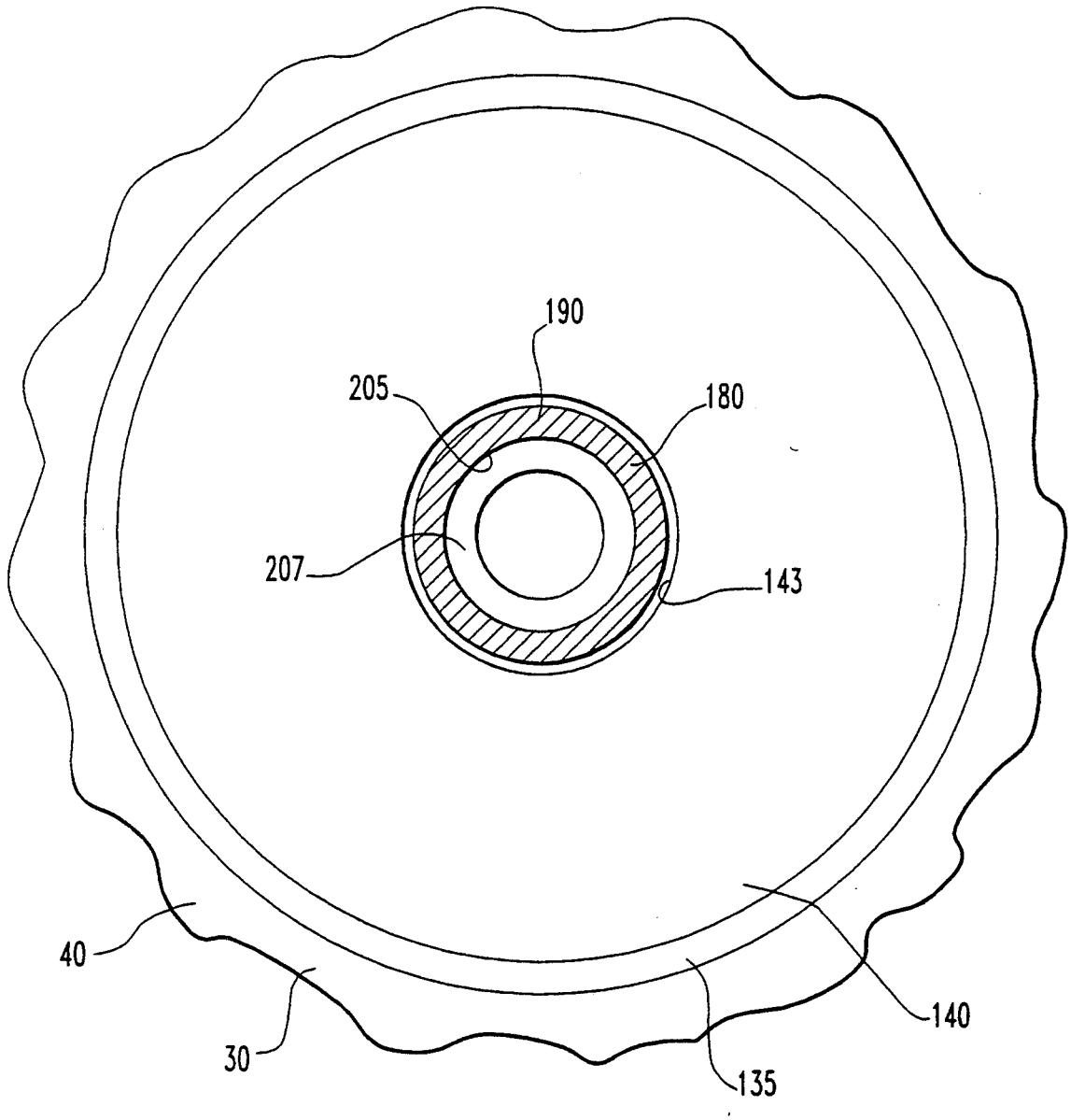
FIG. 4 is a view along section line 4—4 of FIG. 3.
Figure 5:
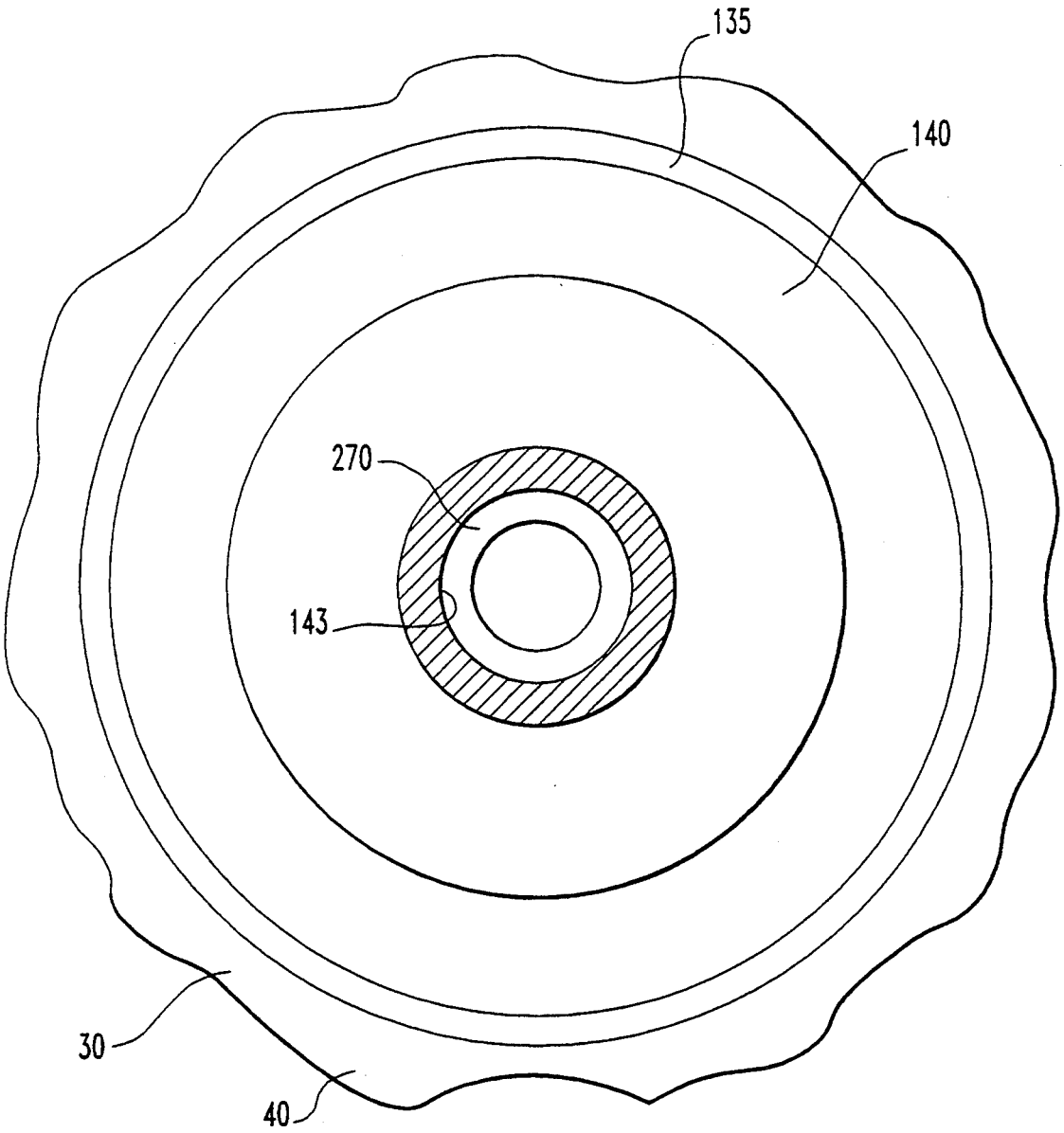
FIG. 5 is a view along section line 5—5 of FIG. 3.

As steam generator 10 operates, the secondary fluid will enter second inlet nozzle structure 140 generally in the direction illustrated by the arrows in the several figures (e.g., FIGS. 1, 2 and 3). The bulk mean temperature of this secondary fluid may be approximately 440 degrees Fahrenheit during normal operation or 32 degrees Fahrenheit during transient conditions. However, the temperature of second inlet nozzle structure 140 may be as high as approximately 500 degrees Fahrenheit during transient conditions. Such a significant temperature difference (approximately 100 degrees Fahrenheit during normal operation or 468 degrees Fahrenheit during transient conditions) may otherwise cause the previously mentioned thermal shock to ultimately induce metal fatigue in second inlet nozzle structure 140, if the secondary fluid were allowed-to contact second inlet nozzle structure 140. Therefore, sleeve 180 extends into bore 143 to thermally insulate the thermally limiting portion (i.e., nozzle knuckle inner radius 230) of second inlet nozzle structure 140 from the effects of thermal shock. However, joint 230 may likewise undergo thermal shock if the secondary fluid were allowed to contact joint 230. Therefore, liner 240 everywhere sealing covers joint 230 to thermally insulate joint 230 from the effects of thermal shock. In this manner, second inlet nozzle structure 140 is suitably insulated from the effects of thermal shock and induced metal fatigue.

Although the invention is fully illustrated and described herein in its preferred embodiment, it is not intended that the invention as illustrated and described be limited to the details shown, because various modifications may be obtained with respect to the invention without departing from the spirit of the invention of the scope of equivalents thereof. For example, feedring 150, sleeve 180 and liner 240 need not be separate elements that are required to be joined together by welding; rather, feedring 150, sleeve 180 and liner 240 may be of a one-piece contiguous construction so that welded joints are eliminated. The advantage of this latter construction is that it reduces the potential for loose-parts in steam generator 10, which loose-parts might otherwise occur in the unlikely event that weldments 210 and 260 fail.

Therefore, what is provided are a device and method for thermally insulating a structure to prevent thermal shock therein, which structure may be a feedwater inlet nozzle of the kind typically found on nuclear steam generators.

What is claimed is:

1. A device for thermally insulating a structure to prevent thermal shock therein, the structure having a bore capable of transmitting a fluid therethrough, comprising:

(a) a sleeve adapted to be joined to the structure to define a joint therebetween, said sleeve extending into the bore for thermally insulating the structure as the fluid is transmitted through the bore; and (b) a liner disposed in said sleeve and covering the joint for thermally insulating the joint as the fluid is transmitted through the bore.

2. For use in a heat exchanger nozzle having a bore therein capable of transmitting a fluid therethrough, the nozzle having a lip portion, a device for thermally insulating the nozzle to prevent thermal shock therein, comprising:

(a) a sleeve adapted to be joined to the lip portion to define a joint therebetween, said sleeve extending into the bore for thermally insulating the nozzle as the fluid is transmitted through the bore; and (b) a liner disposed in said sleeve and covering the joint for thermally insulating the joint as the fluid is transmitted through the bore, said liner joined to said sleeve for affixing said liner to said sleeve, whereby the nozzle is thermally insulated as said sleeve extends into the bore and whereby the joint is thermally insulated as said liner covers the joint.

3. The device of claim 2, wherein said sleeve is formed of a material resistant to thermal fatigue.

4. The device of claim 2, wherein said liner is formed of a material resistant to thermal fatigue.

5. In a nuclear steam generator nozzle having an inner surface defined by a fluid-transmitting bore formed through the nozzle for transmitting a fluid therethrough, the nozzle having an integrally attached annular lip portion projecting into the bore, the fluid and the nozzle defining a temperature difference therebetween, a device for thermally insulating the nozzle to prevent thermal shock therein, the device comprising:

(a) a cylindrical sleeve joined to the lip portion to define a joint therebetween for affixing said sleeve to the lip portion, said sleeve extending into the bore, and interposed between the bore and the fluid for thermally insulating the nozzle as the fluid is transmitted through the bore, the joint and the fluid defining a temperature difference therebetween, said sleeve having an inside surface and an annular flange integrally attached to and inwardly projecting from the inside surface; and (b) a cylindrical liner concentrically disposed in said sleeve and covering the joint for thermally insulating the joint as the fluid is transmitted through the bore, said liner having a first end portion joined to the flange for affixing said liner to the flange and having a second end portion engaging the inner surface of the bore, whereby the temperature difference between the nozzle and the fluid is maintained as the sleeve extends into the bore so that the nozzle is thermally insulated to prevent thermal shock to the nozzle as the fluid is transmitted through the bore and whereby the temperature difference between the joint and the fluid is maintained as said liner covers the joint so that the joint is thermally insulated to prevent thermal shock to the joint as the fluid is transmitted through the bore.

6. The device of claim 5, wherein said sleeve is "INCONEL" for resisting thermal fatigue.

7. The device of claim 5, wherein said liner is "INCONEL" for resisting thermal fatigue.

8. The device of claim 5, wherein the second end portion of said liner slidably engages the inner surface of the bore to allow for thermal expansion of said liner.

9. A method of thermally insulating a structure to prevent thermal shock therein, the structure having a bore capable of transmitting a fluid therethrough, comprising the steps of:

(a) providing a sleeve adapted to be joined to the structure to define a joint therebetween, the sleeve extending into the bore for thermally insulating the structure as the fluid is transmitted through the bore; and (b) providing a liner sized to be disposed in the sleeve and to cover the joint for thermally insulating the joint as the fluid is transmitted through the bore.

10. In a nuclear steam generator having a nozzle having an inner surface defined by a fluid-transmitting bore formed in the nozzle for transmitting a fluid therethrough, the nozzle having an integrally attached lip portion projecting into the bore, the fluid and the nozzle defining a temperature difference therebetween, a method of thermally insulating the nozzle to prevent thermal shock therein, the method comprising the steps of:

(a) thermally insulating the nozzle by extending a cylindrical sleeve into the bore, the sleeve having an inside surface and an annular flange integrally attached to and inwardly projecting from the inside surface;

(b) affixing the sleeve to the nozzle by joining the sleeve to the lip portion to define a joint therebetween, the joint and the fluid defining a temperature difference therebetween;

(c) thermally insulating the joint by concentrically disposing a cylindrical liner in the sleeve and by covering the joint with the liner; and (d) affixing the liner to the sleeve by joining the liner to the flange, whereby the temperature difference between the nozzle and the fluid is maintained as the sleeve extends into the bore, so that the nozzle is thermally insulated to prevent thermal shock to the nozzle as the fluid is transmitted through the bore, and whereby the temperature difference between the joint and the fluid is maintained as the liner covers the joint so that the joint is thermally insulated to prevent thermal shock to the joint as the fluid is transmitted through the bore.

11. The method of claim 10, wherein said step of thermally insulating the nozzle comprises the step of extending a cylindrical "INCONEL" sleeve into the bore for resisting thermal fatigue in the sleeve.

12. The method of claim 10, wherein said step of thermally insulating the joint comprises the step of concentrically disposing a cylindrical "INCONEL" liner in the sleeve and covering the joint with the "INCONEL" liner for resisting thermal fatigue in the liner.

* * * * *